US011325812B2

(12) United States Patent
Sato et al.

(10) Patent No.: US 11,325,812 B2
(45) Date of Patent: May 10, 2022

(54) DAMPING DEVICE FOR MAIN ROPE

(71) Applicant: FUJITEC CO., LTD., Shiga (JP)

(72) Inventors: Koichi Sato, Shiga (JP); Junichi Nakagawa, Shiga (JP); Yusuke Ono, Shiga (JP)

(73) Assignee: FUJITEC CO., LTD., Shiga (JP)

( * ) Notice: Subject to any disclaimer, the term of this patent is extended or adjusted under 35 U.S.C. 154(b) by 199 days.

(21) Appl. No.: 16/775,449

(22) Filed: Jan. 29, 2020

(65) Prior Publication Data

US 2021/0078828 A1 Mar. 18, 2021

(30) Foreign Application Priority Data

Sep. 13, 2019 (JP) ..... JP2019-167546

(51) Int. Cl.
*B66B 7/06* (2006.01)

(52) U.S. Cl.
CPC ..... *B66B 7/068* (2013.01)

(58) Field of Classification Search
CPC .. B66B 7/068; B66B 7/08; B66B 7/06; B66B 7/041; B66B 5/021
See application file for complete search history.

(56) References Cited

U.S. PATENT DOCUMENTS 3,666,051 A * 5/1972 Davis ..... B66B 7/06 187/414
4,079,816 A * 3/1978 Ohta ..... B66B 7/06 174/42
4,106,594 A * 8/1978 Kirsch ..... B66B 5/022 187/278
4,117,908 A * 10/1978 Nara ..... B66B 7/06 187/254
5,025,893 A * 6/1991 Saito ..... B66B 7/06 187/266
9,359,172 B2 * 6/2016 Mangini ..... B66B 7/06
10,669,124 B2 * 6/2020 Copeland ..... B66B 7/06
10,669,125 B2 * 6/2020 Miyajima ..... B66B 7/023
2010/0065381 A1 * 3/2010 Roberts ..... B66B 7/06 187/401

(Continued)

FOREIGN PATENT DOCUMENTS

CN 203033594 U 7/2013
CN 104527396 A 4/2015

(Continued)

OTHER PUBLICATIONS

CN-110709343—Machine Translation (Year: 2017).*
JP351279—Machine Translation (Year: 1991).*

*Primary Examiner* — Michael A Riegelman
(74) *Attorney, Agent, or Firm* — Global IP Counselors, LLP

(57) ABSTRACT

A damping device for a main rope suspending a car of an elevator includes a coupled, a first pulley and a drive. The coupler is attached to the main rope above the car, and is configured to be pulled, in response to vibrations of the main rope, with a damping rope so as to suppress vibrations of the main rope. The first pulley is supported at a same height as a height of the coupler. The drive is configured to suppress vibration of the main rope by pulling a first damping rope coupled to the coupler and passing over the first pulley.

3 Claims, 5 Drawing Sheets

(56) References Cited

U.S. PATENT DOCUMENTS

| | | | | |
|---|---|---|---|---|
| 2013/0048438 | A1* | 2/2013 | Mangini | B66B 7/06 187/414 |
| 2013/0133983 | A1* | 5/2013 | Mangini | B66B 7/06 187/277 |
| 2016/0083223 | A1* | 3/2016 | Altenburger | B66B 7/068 187/251 |
| 2016/0376125 | A1* | 12/2016 | Wells | B66B 5/02 187/266 |
| 2021/0078828 | A1* | 3/2021 | Sato | B66B 7/068 |

FOREIGN PATENT DOCUMENTS

| | | | | |
|---|---|---|---|---|
| CN | 110709343 B | * | 2/2021 | B66B 7/06 |
| JP | H351279 A | | 3/1991 | |

* cited by examiner

DAMPING DEVICE FOR MAIN ROPE

CROSS-REFERENCE TO RELATED APPLICATION

This application claims priority to Japanese Patent Application No. 2019-167546, filed Sep. 13, 2019, the content of which is hereby incorporated herein by reference.

BACKGROUND

Field of the Invention

The present invention relates to a damping device for main rope, and particularly relates to a damping device for a main rope of an elevator that suppresses the vibration of the main rope due to the shaking of the building equipped with the elevator due to earthquakes and the like.

Background Information

Recently developed multistory buildings equipped with a roped elevator have a problem vibration that the main rope vibrates when the building shakes due to earthquakes or strong wind.

Many such roped elevators in the multistory buildings have a machine room immediately above the upper part of the car's hoistway, and have a hoist to drive the car toward the machine room. The main rope passes over a sheave forming the hoist, and the main rope is coupled to the car at one end and a counter weight at the other end to suspend the car and the counter weight.

A motor rotates the sheave in the forward and reverse directions so as to move the car up and down while guiding the car along a pair of guide rails that extend vertically.

When buildings that have these types of elevators shake, due to a long-period ground motion, for example, the main rope suspending the car from the uppermost part of the building also vibrates in the horizontal direction that is the substantially same direction as that of the shaking of the building (hereinafter the vibration of the main rope in the horizontal direction is called "horizontal vibration").

Conventional techniques estimate the magnitude of the main-rope vibration by using a long-period ground motion sensor installed at the building to detect the magnitude of the building shaking, and control the elevator operation for emergency in accordance with the magnitude of the main rope vibration to temporarily stop the service of the elevator as required.

The problem with this technique is that normal operation of the elevator cannot be resumed after the building shaking stops until the main rope vibration ends. Furthermore, if the main rope resonates due to earthquakes or strong wind, the vibration of the main rope can increase. In such a situation, the main rope can contact various devices in the hoistway and break these devices. The broken devices require the repair by workers, which require an even longer duration to resume the normal operation of the elevator.

JPH03-51279 A discloses a conventional damping device for main rope. This damping device includes a clamp (coupler) attached to a main rope, and a damping rope connecting to the clamp and extending obliquely downward from the clamp and passing over pulleys at the opposed corners of the top face of the car to be coupled to an actuator at the center of the top face. This damping device pulls the damping rope with the actuator so as to oscillate the clamp and suppress the horizontal vibration of the main rope.

SUMMARY

In the damping device described in JPH03-51279 A, the damping rope needs to be pulled obliquely downward to suppress the horizontal vibration of the main rope. It has been determined that this procedure requires a larger tensile force to pull the damping rope than a configuration that pulls the main rope in a substantially horizontal direction that is parallel to the horizontal vibration, and the conventional technique fails to efficiently suppress the horizontal vibration of the main rope.

The embodiments of the present invention described herein can provide a damping device to main rope that is capable of efficiently suppressing horizontal vibration of the main rope.

One aspect of the present invention is to provide a damping device for a main rope that suppresses vibration of the main rope suspending a car of an elevator, and the damping device is configured to, in response to vibration of the main rope, pull a coupler attached to the main rope with a damping rope so as to suppress vibration of the main rope. The damping device includes the coupler attached to the main rope above the car; a first pulley supported at a same height as a height of the coupler; and a driving unit having a function of suppressing vibration of the main rope by pulling a first damping rope coupled to the coupler and passing over the first pulley.

In one embodiment of the damping device for the main rope of the present invention, the first damping rope connects to the coupler via a rotatable connector.

One embodiment of the damping device for the main rope of the present invention further includes: a second pulley opposed to the first pulley having the coupler between the first pulley and the second pulley; and a tension providing unit coupled to the coupler and configured to pull the coupler via a second damping rope passing over the second pulley.

In the damping device for main rope as described herein, the driving unit pulls the first damping rope that passes over the first pulley disposed at the same height as that of the coupler. This enables pulling of the coupler in a substantially horizontal direction with the first damping rope, and thus efficiently suppresses the horizontal vibration of the main rope.

BRIEF DESCRIPTION OF THE DRAWINGS

The invention will be explained in more detail hereinafter with reference to the drawings.

DETAILED DESCRIPTION OF THE EMBODIMENTS

Figure 1:
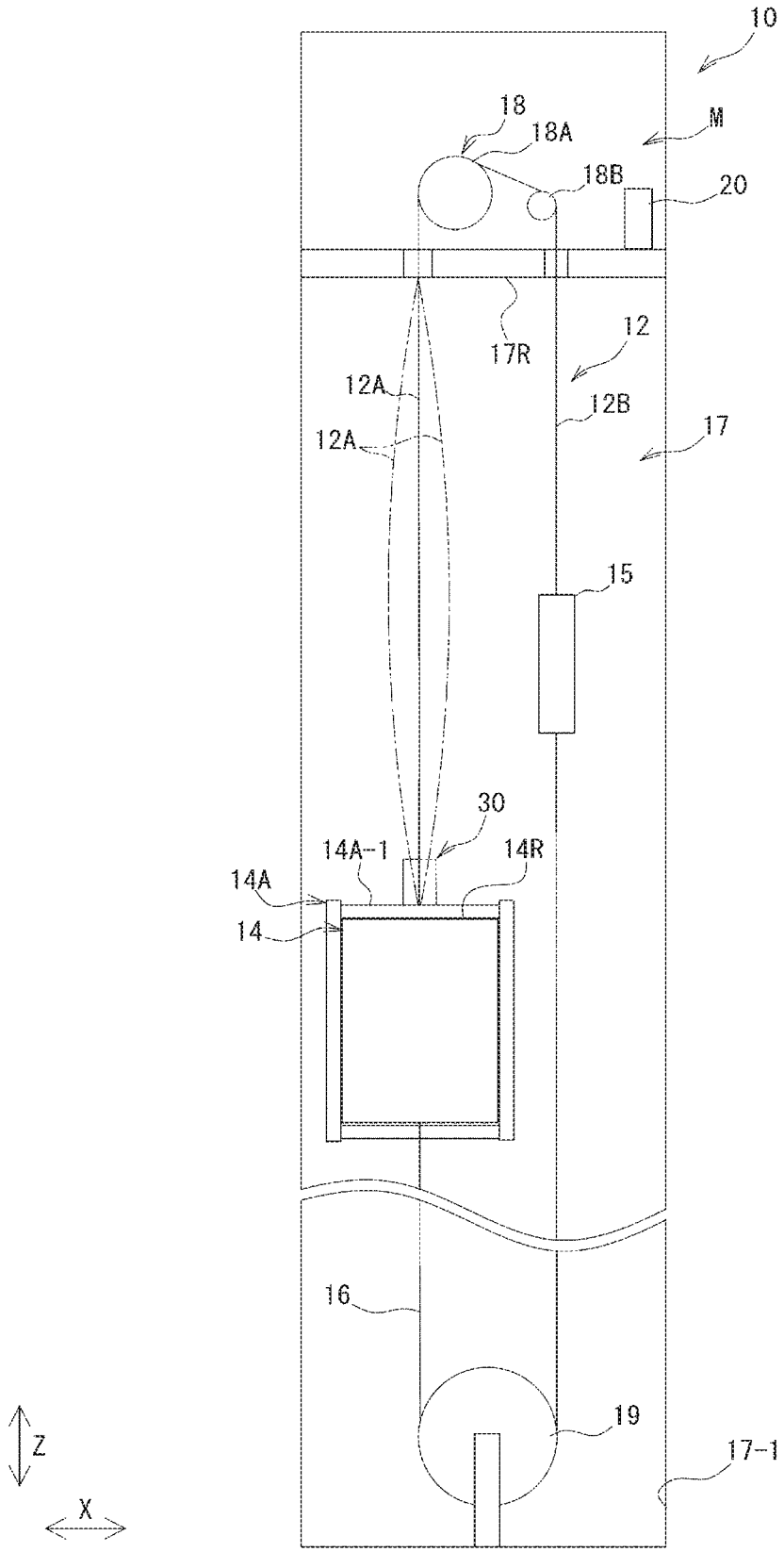
FIG. 1 shows the overall configuration of an elevator including a damping device for main rope that is one embodiment of the present invention.

Referring to the drawings, the following describes an elevator 10 including a damping device for main rope that is one embodiment of the present invention. In the drawings, "X" denotes the horizontal direction X parallel to the longitudinal direction of an upper beam 14A-1, "Y" denotes the horizontal direction Y orthogonal to the horizontal direction X, and "Z" denotes the vertical direction Z orthogonal to the horizontal directions X and Y. The horizontal direction X and the horizontal direction Y can be called X direction and Y direction, respectively, as appropriate.

FIG. 1 schematically shows the configuration of the elevator 10. For simplicity, FIG. 1 shows a main rope group 12 as one rope. As shown FIG. 1, the elevator 10 is a traction-type roped elevator, and includes the main rope group 12 made up of a plurality of main ropes 12-1, 12-2, 12-3, . . . , (see FIG. 2) that suspends a car frame 14A supporting a car 14 at one end and suspends a counter weight 15 at the other end. A damping device for the main rope (hereinafter called a "damping device" or "damper") 30 is attached to the car frame 14A. The car 14 is movable up and down in the vertical direction Z along a pair of guide rails (not shown) installed corresponding to the car 14 on the wall of a hoistway 17. Similarly, the counter weight 15 is also movable up and down in the vertical direction Z along a pair of guide rails (not shown) installed corresponding to the counter weight 15.

The car frame 14A also connects to one end of a compensation rope 16 that compensates for the unbalanced weight of the main rope group 12 and a traveling cable (not shown) when the suspended weight of them changes with the vertical position of the car 14. This compensation rope 16 passes over a tension pulley 19 disposed at a pit 17-1 that is a bottom of the hoistway 17. The other end of the compensation rope 16 connects to the lower end of the counter weight 15.

The main rope group 12 passes over a sheave 18A and a deflector sheave 18B of the hoist 18 installed in a machine room M immediately above the hoistway 17. The main rope group 12 moves the car 14 and the counter weight 15 up and down, when a hoist motor (not shown) rotates the sheave 18A forwardly or reversely, relatively. The elevator 10 has a control unit (electronic controller) 20 in the machine room M, and the control unit 20 controls the operation of the hoist 18 or the like and the operation of the damping device 30. The present embodiment is configured so that the control unit 20 in the machine room M controls the damping device 30, however, the present invention is not limited to such an embodiment. In another embodiment, the elevator can include a control unit on the top face 14R of the car 14 to control the operation of the damping device 30.

Hereinafter a part of the main rope group 12 that suspends the car 14 is called a car-side main rope group 12A, and a part of the main rope group 12 that suspends the counter weight 15 is called a counter weight-side main rope group 12B, as needed. According to such a definition on the main rope group, the lengths of the car-side main rope group 12A and the counter weight-side main rope group 12B of the main rope group 12 change with a vertical position of the car 14. FIG. 1 schematically shows one example of the horizontal vibration (described later in details) of the car-side main rope group 12A with dashed-dotted lines.

Figure 2:
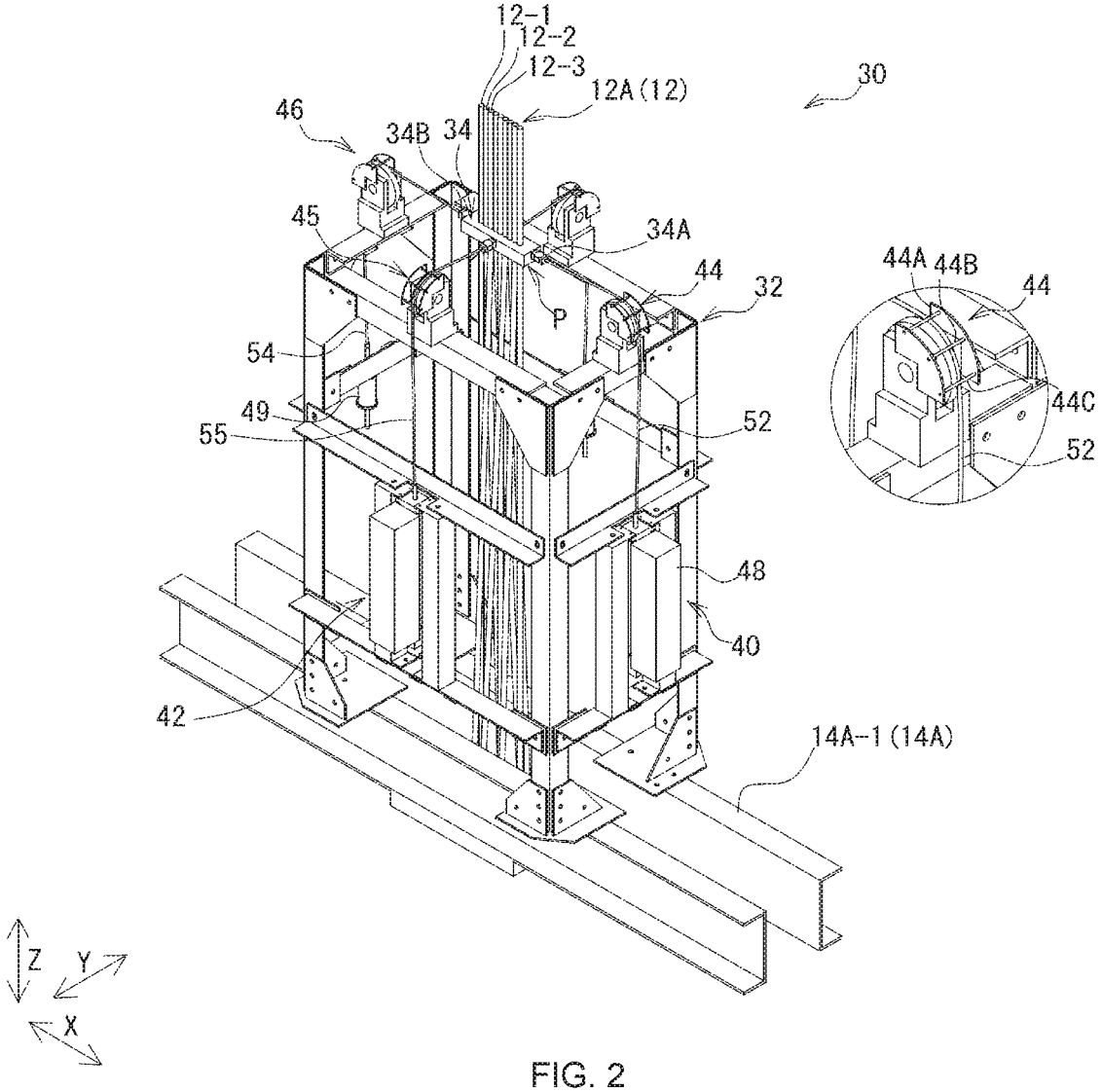
FIG. 2 is a perspective view of the damping device for main rope shown in FIG. 1.
Figure 3A:
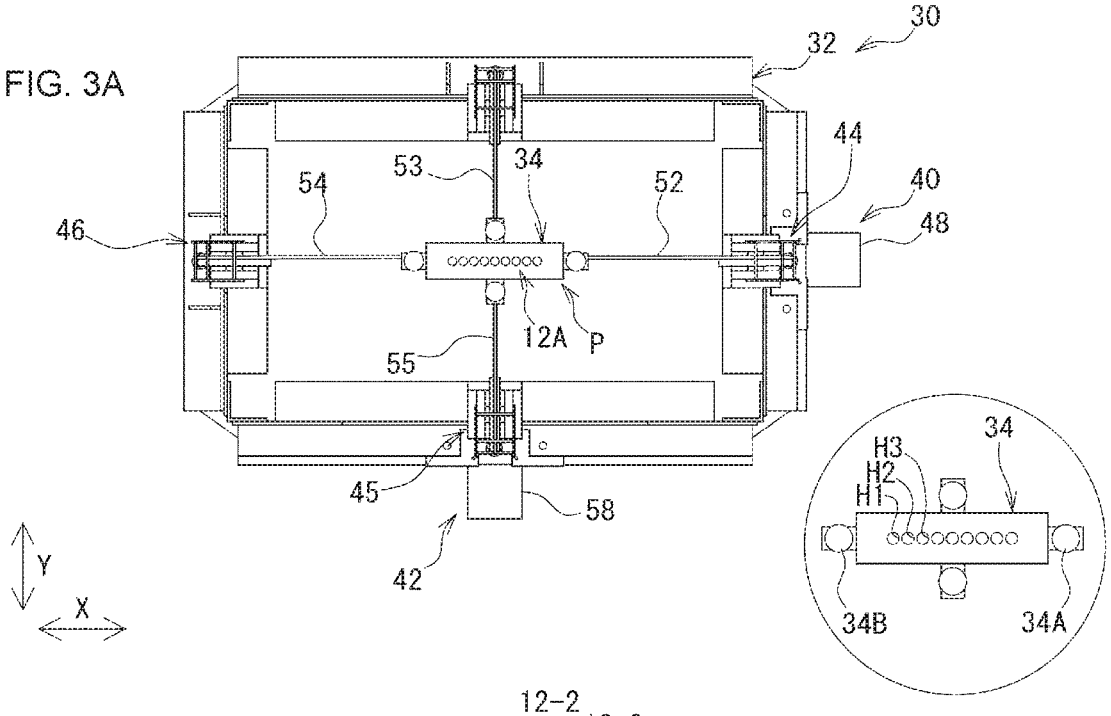
FIG. 3A is a top plan view of the damping device for main rope shown in FIG. 2, and also shows an enlarged view of a coupler of the damping device for main rope within the circle.
Figure 3B:
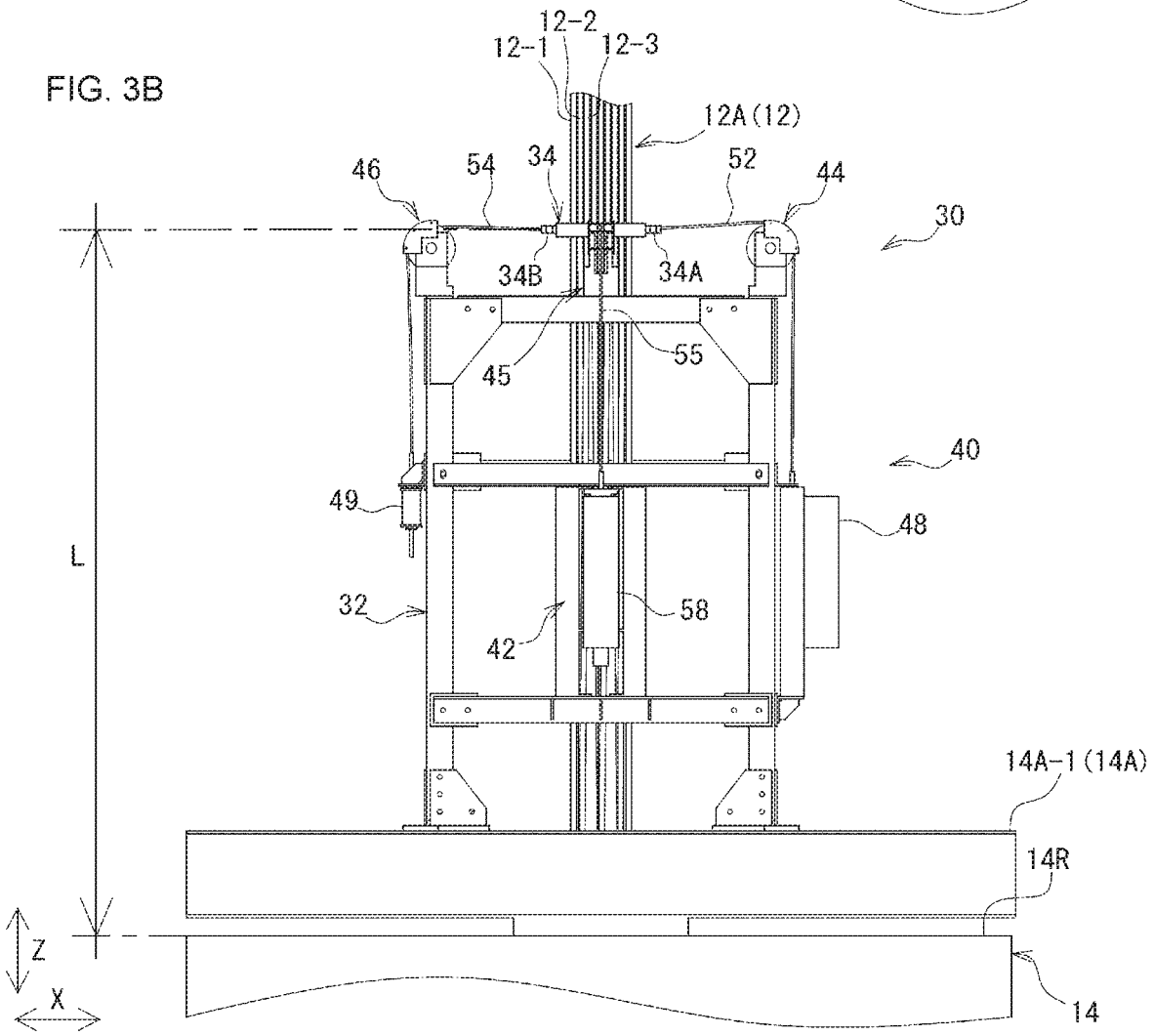
FIG. 3B is a side view of the damping device for main rope shown in FIG. 2.

FIG. 2 is a perspective view of the damping device 30. FIG. 3A is a top plan view of the damping device 30. For simplicity, FIG. 3A omits the upper beam 14A-1 and a part of the car-side main rope group 12A below the coupler 34, and omits hatching for cross section of the car-side main rope group 12A. FIG. 3B is a side view of the damping device 30.

As shown in FIG. 2, when the car-side main rope group 12A vibrates in the horizontal direction (hereinafter such vibration of the car-side main rope group 12A in the horizontal direction is called "horizontal vibration"), the damping device 30 exerts suppresses the horizontal vibration of the car-side main rope group 12A. The damping device 30 includes: a support 32; a coupler 34 located above the car 14 and attached to the car-side main rope group 12A; and two damping units (dampers) 40 and 42 to suppress horizontal vibration of the car-side main rope group 12A.

The support 32 is attached to the upper beam 14A-1 forming the car frame 14A, and is a structure having a substantially quadrangular frame shape viewed from the above and surrounding the car-side main rope group 12A.

As shown in FIG. 3A and FIG. 3B, the damping units 40 and 42 are mutually orthogonal in the top plan view. Since these damping units 40 and 42 have substantially the same structure, the following mainly describes the damping unit 40 only and omits the descriptions on the damping unit 42 as appropriate.

As shown in FIG. 3A and FIG. 3B, the damping unit 40 suppresses horizontal vibration of the car-side main rope group 12A via damping ropes 52 and 54 coupled to the coupler 34. The damping unit 40 includes: a first pulley 44 and a second pulley 46 that are opposed with the coupler 34 therebetween; and an actuator (driving unit or drive) 48 and an elastic unit (tension providing unit or tensioner) 49 to provide a tensile force to the damping ropes 52 and 54 passing over the pulleys 44 and 46. The damping rope 52 corresponds to a 52 and the damping rope 54 corresponds to a second damping rope.

Each of these pulleys 44 and 46 is rotatable around a shaft that is substantially parallel to the vertical direction Z, and is supported at an upper part of the support 32 at the same height as that of the coupler 34. This configuration enables pulling of the car-side main rope group 12A in a substantially horizontal direction toward both ends of the coupler 34 via the damping ropes 52 and 54.

The present embodiment is configured to pull the car-side main rope group 12A with the damping ropes 52 and 54. In another embodiment, the car-side main rope group 12A can be pulled with the damping rope 52 only. In such an embodiment, the actuator 48 pulls the damping rope 52, and this suppresses vibration of the car-side main rope group 12A. This embodiment does not need the second pulley 46 because it does not have the damping rope 54.

The pulleys 44 and 46 are rotatably supported, and thus even if the coupler 34 is displaced from origin P due to horizontal vibration of the car-side main rope group 12A, the pulleys 44 and 46 rotate while following the displacement and keep directed to the coupler 34. This structure avoids the detachment of the damping ropes 52 and 54 from the pulleys 44 and 46.

As shown in FIG. 2, the first pulley 44 has latches 44A, 44B, and 44C to prevent the detachment of the damping rope 52. The latches 44A, 44B, and 44C can more reliably avoid the detachment of the damping rope 52 from the first pulley 44. The second pulley 46 also has the substantially same configuration as that of the first pulley 44, as stated above.

As shown in FIG. 3A and FIG. 3B, the coupler 34 is a plate member attached to the car-side main rope group 12A at a position above the car 14 away from the top face 14R by predetermined distance L. Preferably a distance L is 0.5 m or more for a sufficient effect of suppressing horizontal vibration of the car-side main rope group 12A.

For safety, the distance between the uppermost part of the damping device 30 when the car stops (landed) at the highest floor and a ceiling 17R (see FIG. 1) of the hoistway 17 has to be set at a predetermined value or more, and so the distance L is preferably 1.9 m or less. That is, the distance L is preferably set within the range of $0.5\ m \leq L \leq 1.9\ m$.

The main ropes 12-1, 12-2, 12-3, . . . of the car-side main rope group 12A pass through through-holes H1, H2, H3, . . . , respectively, which are bored at the coupler 34 so as to correspond to the main ropes 12-1, 12-2, 12-3, . . . . These main ropes 12-1, 12-2, 12-3, . . . can be movable in the vertical direction Z relative to the coupler 34 or can be fixed to the coupler 34 with a fastener, such as a bolt.

As shown in FIG. 3A and FIG. 3B, the damping ropes 52 and 54 preferably couple to the coupler 34 at one end via joints (connectors) 34A and 34B, respectively, that are rotatable around the axis substantially parallel to the vertical direction Z. When the car-side main rope group 12A vibrates horizontally, a force will act on the damping ropes 52 and 54 to bend the ropes 52 and 54. These joints 34A and 34B reduce such a force. The joints 34A and 34B can be adjustable joints (universal joints).

The other end of the damping rope 52 passing over the first pulley 44 connects to the actuator 48, and the actuator 48 is attached to a lateral face of the support 32 immediately below the pulley 44. Preferably the actuator 48 is of a hydraulic or an electric type. The other end of the damping rope 54 passing over the second pulley 46 connects to the elastic unit 49, and the elastic unit 49 is attached to a lateral face of the support 32 immediately below the pulley 46. This elastic unit 49 stores an elastic spring (not shown), and gives a tensile force to the second damping rope 54 due to the elastic force of the spring.

With this configuration, before the car-side main rope group 12A vibrates horizontally, the coupler 34 is pulled in mutually opposite directions that are substantially parallel to the horizontal direction X with the damping ropes 52 and 54. The coupler 34 is also pulled in mutually opposite directions that are substantially parallel to the horizontal direction Y with the damping ropes 53 and 55. In this way, the coupler 34 is held at the origin P that is the center of the support 32 while being pulled in the directions that are substantially parallel to the horizontal direction X and the horizontal direction Y.

As stated above, the damping device is configured so that the actuator 48 and the elastic unit 49 pull the damping ropes 52 and 54 in mutually opposite directions. With this configuration, when the actuator 48 changes the tensile force acting on the damping rope 52, the tensile force acting on the damping rope on the other side from the elastic unit 49 accordingly changes. Advantageously this suppresses bending (in other words, slack) of the damping ropes 52 and 54 resulting from the driving of the actuator 48. The damping unit 40 of the present embodiment includes the elastic unit 49 as the tension providing unit. In another embodiment, the elastic unit 49 can be replaced with another actuator having the same configuration as that of the actuator 48. In such an embodiment, this actuator pulls the damping rope 54, and so yields similar effects to those from the present embodiment.

The actuator 48 is attached to the lateral face of the support 32, and pulls the damping rope 52 when the car-side main rope group 12A vibrates horizontally. In this manner, the actuator 48 is attached to the lateral face of the support 32 and not on the top face 14R of the car 14, and this suppresses transmission of driving noise of the actuator 48 to the inside of the car 14.

The control unit 20 (see FIG. 1) detects vibration of the car-side main rope group 12A via a plurality of rope vibration detection sensors (not shown) installed in the hoistway 17, and controls the operation of the damping device 30 based on the detection result so as to suppress horizontal vibration of the car-side main rope group 12A. In a specific example, when incident waves as horizontal vibration of the car-side main rope group 12A occur due to the shaking of the building, the control unit 20 controls the damping units 40 and 42 to oscillate the car-side main rope group 12A so as to generate reflected waves that cancel out these incident waves, i.e., to vibrate the car-side main rope group 12A horizontally in that way. This suppresses the horizontal vibration of the car-side main rope group 12A.

For the control unit 20 to control the operation of the damping device 30, a suitable operation pattern can be calculated beforehand by simulation, for example, to suppress horizontal vibration of the car-side main rope group 12A. Such a suitable operation pattern to suppress horizontal vibration of the car-side main rope group 12A can be calculated through an experiment. In one example, this experiment can operate the damping device 30 in a certain operation pattern while actually vibrating the car-side main rope group 12A horizontally.

The control unit 20 of the present embodiment finds the position of the car-side main rope group 12A having the maximum amplitude in the vertical direction Z based on the positional information on the car-side main rope group 12A acquired from the rope vibration detection sensors (not shown). The control unit 20 then calculates X and Y-directional components of the amplitude of the rope group 12A at this position of the maximum amplitude, and controls the driving of the damping device 30 based on the magnitude of these X and Y-directional components.

More specifically the control unit 20 controls the driving of the damping unit 40 based on the X-directional component as stated above and controls the driving of the damping unit 42 based on the Y-directional component as stated above. In this manner, the control unit 20 separately suppresses the X-directional components and the Y-directional components of the horizontal vibration of the car-side main rope group 12A with the damping units 40 and 42.

Figure 4A:
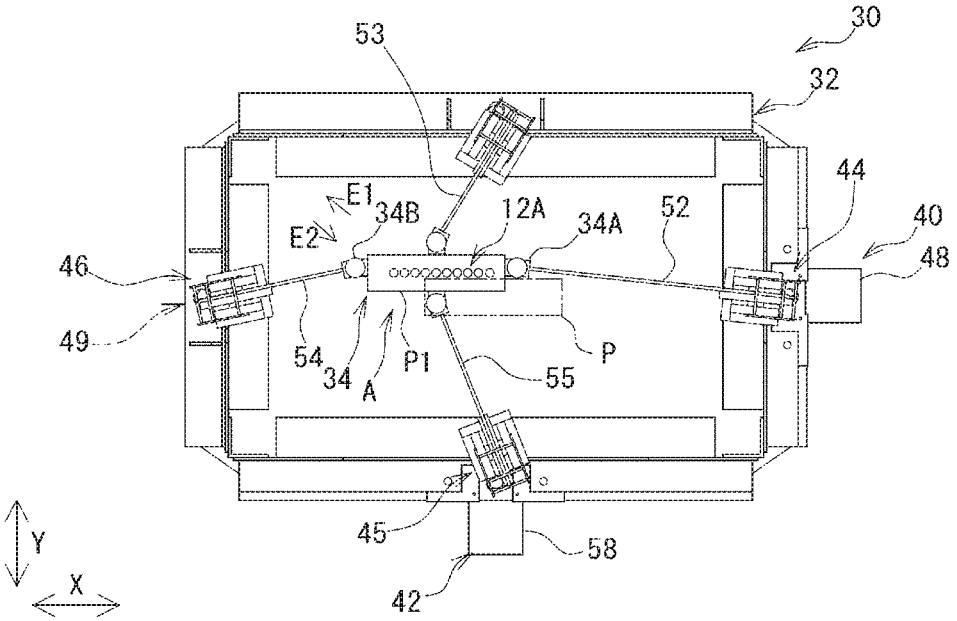
FIG. 4A shows the operating state of the damping device for main rope similarly to FIG. 3A when the coupler vibrates horizontally from the origin in E1 direction.
Figure 4B:
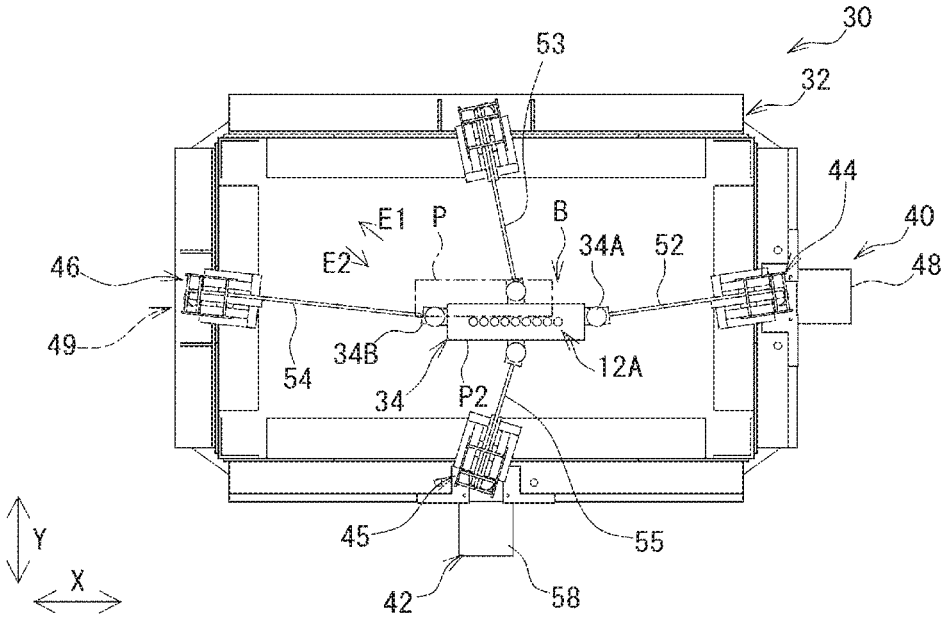
FIG. 4B shows the operating state of the damping device for main rope similarly to FIG. 3A when the coupler vibrates horizontally from the origin in E2 direction.

Next referring to FIG. 4A and FIG. 4B, the following describes how the control unit 20 controls the operation of the damping units 40 and 42. FIG. 4A shows the horizontal vibration of the car-side main rope group 12A in the direction away from both of the actuators 48 and 58. FIG. 4B shows the horizontal vibration of the car-side main rope group 12A in the opposite direction of FIG. 4(*a*), i.e., closer to both of the actuators 48 and 58. In FIG. 4A and FIG. 4B, dashed-dotted lines indicate the origin P as stated above.

Since the manner in which the operation is controlled is substantially the same between the damping units 40 and 42, the following mainly describes the manner of controlling the operation of the damping unit 40 and omits the descriptions on the damping unit 42 as appropriate.

As shown in FIG. 4A and FIG. 4B, the car-side main rope group 12A vibrates horizontally from the origin P to reach the position P1 in the E1 direction. At position P1, the vibration direction changes to the E2 direction, and the car-side main rope group 12A passes through the origin P again to reach position P2 on the other side. At position P2, the vibration direction changes to the E1 direction, and the car-side main rope group 12A moves toward the position P. In the drawings, A indicates the region between the origin P and the position P1, and B indicates the region between the origin P and the position P2.

In the following, Ts denotes the tensile force of the elastic unit 49 pulling the damping rope 54, and Ta denotes the tensile force of the actuator 48 pulling the damping rope 52. For the tensile forces in the X direction of the present embodiment, the tensile force Ts acting on the damping rope 54 is significantly larger than the tensile forces acting on the damping ropes 53 and 55. The tensile force Ta to be applied to the damping rope 52 is therefore set while considering the tensile force Ts acting on the damping rope 54 only.

As shown in FIG. 4A, the present embodiment is configured so that the rope vibration detection sensors (not shown) detect vibration of the car-side main rope group 12A, and the control unit 20 controls the actuator 48. The control unit 20 controls the actuator 48 to drive the actuator such that Ts≥Ta during horizontal vibration of the coupler 34 at region A.

As shown in FIG. 4B, the control unit 20 controls the actuator 48 to drive the actuator such that Ta≥Ts during horizontal vibration of the coupler 34 at region B. The control unit 20 controls the actuator 48 to drive the actuator so that the tensile force Ta is the maximum at position P2. This is suitable to quickly suppress the horizontal vibration of the car-side main rope group 12A.

Figure 5A:
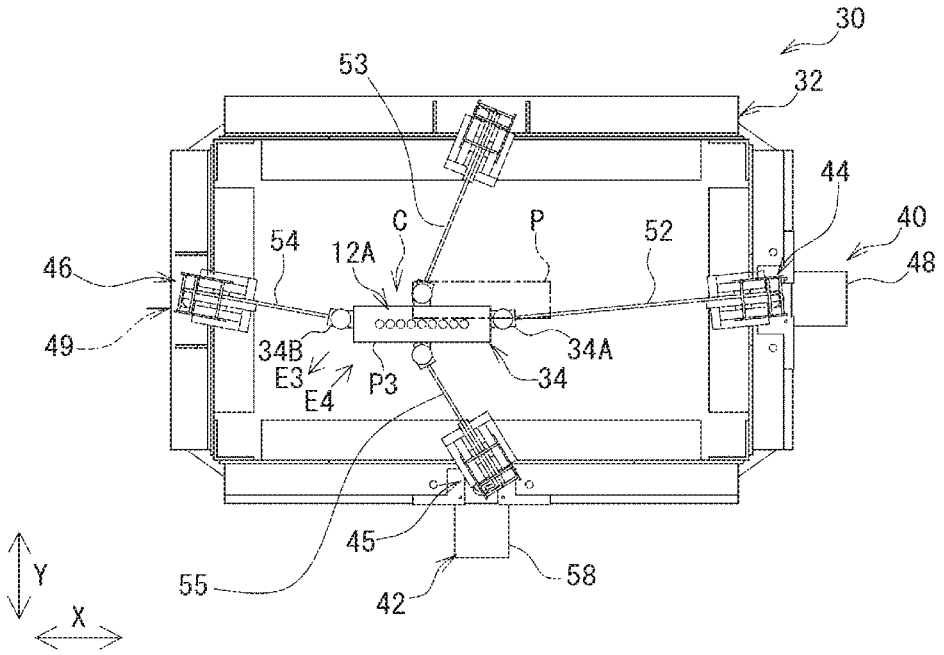
FIG. 5A shows the operating state of the damping device for main rope similarly to FIG. 3A when the coupler vibrates horizontally from the origin in E3 direction.
Figure 5B:
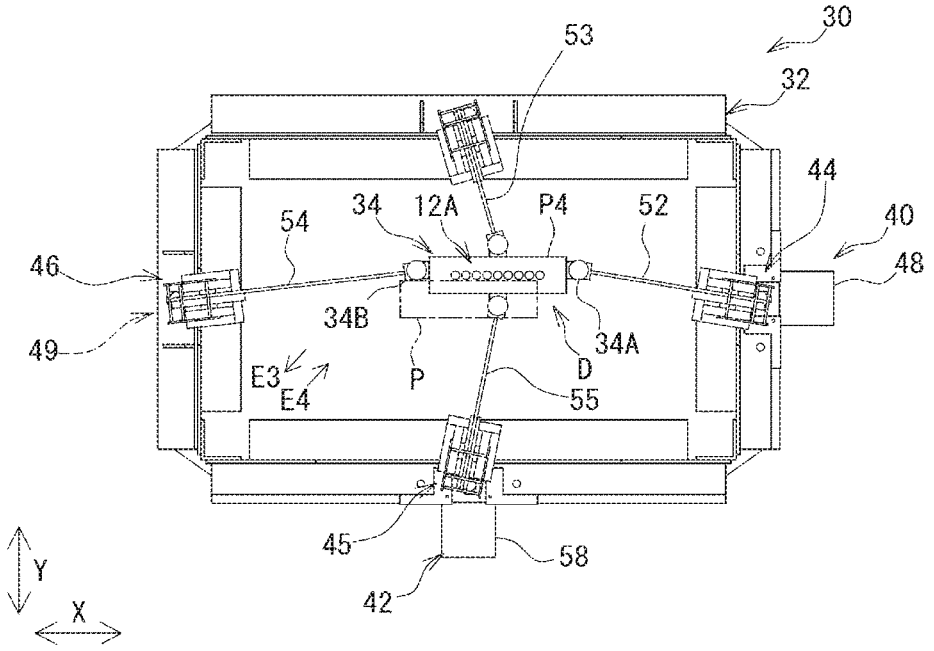
FIG. 5B shows the operating state of the damping device for main rope similarly to FIG. 3A when the coupler vibrates horizontally from the origin in E4 direction.

Referring next to FIG. 5A and FIG. 5B, the following describes how the control unit 20 controls the operation of the damping units 40 and 42. FIG. 5A shows the horizontal vibration of the car-side main rope group 12A in the direction closer to the actuator 58 and the elastic unit 49. FIG. 5B shows the horizontal vibration of the car-side main rope group 12A in the opposite direction that is away from the actuator 58 and the elastic unit 49. In FIG. 5A and FIG. 5B, dashed-dotted lines indicate the origin P as stated above.

As shown in FIG. 5A and FIG. 5B, the car-side main rope group 12A vibrates horizontally from the origin P to reach the position P3 in the E3 direction. At position P3, the vibration direction changes to the E4 direction, and the car-side main rope group 12A passes through the origin P again to reach position P4. At position P4, the vibration direction changes to the E3 direction, and the car-side main rope group 12A moves toward the position P. In the drawings, C indicates the region between the origin P and the position P3, and D indicates the region between the origin P and the position P4.

As shown in FIG. 5A, similarly to region A, the control unit 20 controls the actuator 48 to drive the actuator such that Ts≥Ta during horizontal vibration of the coupler 34 at region C. Similarly to region B, the control unit 20 controls the actuator 48 to drive the actuator such that Ta≥Ts during horizontal vibration of the coupler 34 at region D. The control unit 20 controls the actuator 48 to drive the actuator so that the tensile force Ta is the maximum at position P4. This is suitable to quickly suppress the horizontal vibration of the car-side main rope group 12A.

The present embodiment sets the magnitude of the tensile force Ta to be applied from the actuator 48 to the damping rope 52 while considering the magnitude of the tensile force Ts of the damping rope 54. In another embodiment, the tensile force Ta can be set while considering the magnitude relationship with a corrected value obtained by multiplying the tensile force Ts by a compensation coefficient. Another embodiment sets the tensile force Ta to be applied from the actuator 48 to the damping rope 52 while considering the magnitude relationship with the sum of a component force in X direction of the tensile force Ts of the damping rope 54 and a component force in X direction of the tensile force of the damping rope 53.

The damping device 30 for a main rope of the present embodiment includes the first pulley 44 of the damping unit 40 and the first pulley 45 of the damping unit 42 that are at the same height as that of the coupler 34, and the damping rope 52 and 55 passing over the first pulley 44 and the first pulley 45, respectively, and pulls these ropes 52 and 55 in this state. This enables pulling of the coupler 34 attached to the car-side main rope group 12A in the directions substantially parallel to the horizontal direction X and the horizontal direction Y, and so suppresses horizontal vibration of the car-side main rope group 12A efficiently.

The present embodiment describes the example of the orthogonally arranged damping units 40 and 42 to suppress the horizontal vibration of the car-side main rope group 12A. Another embodiment can include any one of the damping units 40 and 42. Such an embodiment also suppresses the horizontal vibration of the car-side main rope group 12A.

Embodiments of the present invention can be variously improved, altered, or modified based on the knowledge of those skilled in the art without departing from the spirit of the present invention. Any matters specifying the invention can be replaced with other techniques in an embodiment as long as the same action or effects are obtained from the embodiment.

The invention claimed is:

1. A damping device for a main rope suspending a car of an elevator, the damping device, comprising:

a coupler attached to the main rope above the car, the coupler configured to be pulled, in response to vibrations of the main rope, with a first damping rope so as to suppress vibrations of the main rope;

a first pulley supported at a same height as a height of the coupler; and a drive configured to suppress vibration of the main rope by pulling the first damping rope coupled to the coupler and passing over the first pulley.

2. The damping device for the main rope according to claim 1, wherein the first damping rope is coupled to the coupler via a rotatable connector.

3. The damping device for the main rope according to claim 1, further comprising:

a second pulley opposed to the first pulley with the coupler disposed between the first pulley and the second pulley; and a tensioner coupled to the coupler and configured to pull the coupler via a second damping rope passing over the second pulley.

* * * * *